US005797411A

United States Patent [19]

Parker

[11] Patent Number: 5,797,411

[45] Date of Patent: Aug. 25, 1998

[54] TENT FRAMEWORK

[76] Inventor: Alonzo E. Parker, 1031 S. Plum St., Durham, N.C. 27701

[21] Appl. No.: 835,767

[22] Filed: Apr. 8, 1997

[51] Int. Cl.[6] ..... E04H 15/46

[52] U.S. Cl. ..... 135/136; 135/88.13; 135/99; 135/139; 135/143; 135/158; 135/900

[58] Field of Search ..... 135/88.13, 99, 135/136, 139, 143, 158, 900

[56] References Cited

U.S. PATENT DOCUMENTS

| | | | |
|---|---|---|---|
| 229,831 | 7/1880 | Larter | 135/99 X |
| 2,044,659 | 6/1936 | Adams | 135/99 |
| 5,490,532 | 2/1996 | Mallookis et al. | 135/99 X |

*Primary Examiner*—Christopher Kent
*Attorney, Agent, or Firm*—Olive & Olive, P.A.

[57] ABSTRACT

A framework is provided for a tent canopy which is capable of being erected and collapsed quickly and simply. A cart is able to support the tent framework during erecting and collapsing and is used for transporting between erection sites. The framework has a center post which is pivotally attached to four roof beams which are oriented at 90 degree increments. Each roof beam is pivotally attached to a leg and each leg to two side bars, which side bars are linearly connectable to a mating side bar mounted on an adjacent leg. Each leg pivots to a vertical orientation and rests on the ground. The framework uses a cord and pulley apparatus for collapsing the cloth canopy which covers the framework.

6 Claims, 10 Drawing Sheets

TENT FRAMEWORK

BACKGROUND OF THE INVENTION

1. Field of the Invention

This invention relates generally to tents, and more particularly to a framework for the support of the cloth covering of a tent adapted to be quickly erected or collapsed.

2. Description of the Related Art

A tent is generally known as being made of a cloth covering and a structural framework which rests on, or is partially anchored to the ground. Tents have many uses, including temporary shelter for camping, an entertainment event, an outdoor party, or covering provided at a funeral gravesite.

The latter two uses have certain characteristics in common. First, the tent used is typically erected and collapsed frequently. Second, the tent roof portion must be high enough for participants to stand and walk underneath. Third, the tent support should be comparatively rigid. Fourth, the tent roof portion is typically relatively flat.

In the context of the funeral use of tents, it is common to erect a tent to protect the persons attending from the elements. A crew of two or three workers typically brings the tent to the site for erection by means of a cart or a truck. Corner post supports are partly driven into the ground (which can be a difficult task in cold weather), and the balance of the framework is assembled. The cloth covering is then placed onto the framework and secured in position. Two workers normally can erect a tent of approximately sixteen feet square in about forty-five minutes. A similar amount of time is required for collapsing the tent. Considering the number of times a tent is erected and disassembled in use at funerals and the like, the time involved can add significant cost.

It is therefore an object of this invention to provide a tent framework which is erected and collapsed with a minimum of labor and time.

It is a further object of this invention to provide a tent framework which does not require anchoring portions to be inserted into the ground.

It is an additional object of this invention to provide a tent framework which can be quickly collapsed to a compact size and easily transported from site to site.

Other objects and advantages will be more fully apparent from the following disclosure and appended claims.

SUMMARY OF THE INVENTION

The present invention comprises a tent framework which is able to be erected or collapsed by a single worker in a minimum of time, including placement of the cloth cover. Each of the corners of the tent framework includes a leg pivotably connected to a roof beam and a pair of side bars. The roof beams of each corner frame are pivotally connected at the tent center to a telescoping center post. Each of the side bars is connected to a mating side bar of an adjacent leg of the tent by connectors. The process of erecting and collapsing the tent framework is aided by the use of a cart which provides support therefor and is used to transport the tent framework between sites. The cloth cover which is folded to the top center while the tent framework is being erected, is extended and secured to the side bars and corner legs when the tent framework has been erected.

DETAILED DESCRIPTION OF THE INVENTION AND PREFERRED EMBODIMENT THEREOF

Figure 1:
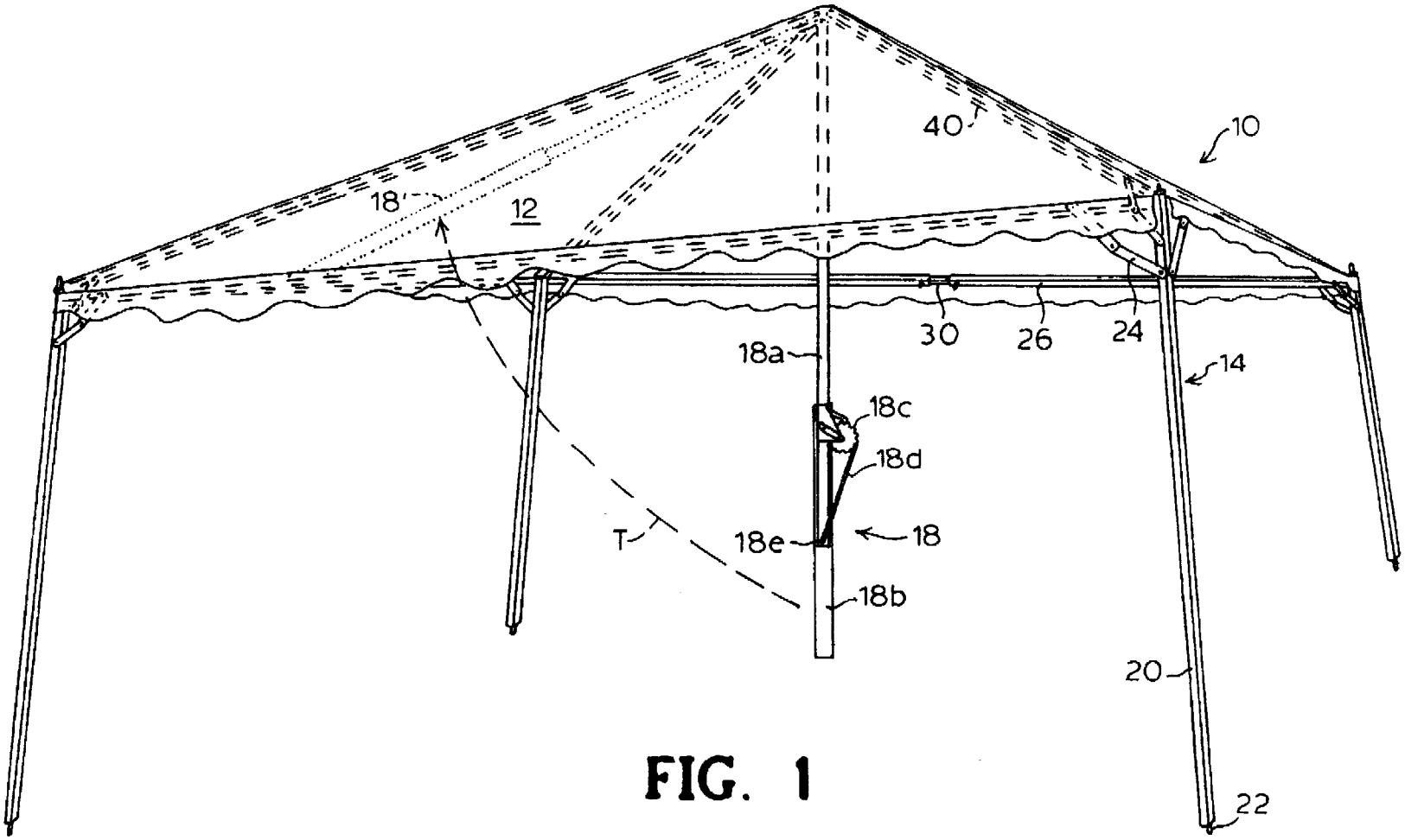
FIG. 1 is a perspective view of a canopy type tent having a tent supporting structure according to the present invention.

According to the objects of the invention described above, a preferred embodiment of a quickly erectable and collapsible tent 10 having a cloth canopy 12 and no side cover is shown in perspective view in FIG. 1. Framework 14, adapted for maintaining canopy 12 at a selected distance above the ground so that people are able to stand beneath it, includes four legs 20, a center post 18, and four sides, each side comprising two side bars 26. Each side bar 26 is pivotably connected to a leg 20 and releasably connected to an opposing side bar 26 by connector 30. A folding buttress 24, when extended, is employed to maintain each respective side bar 26 in substantially perpendicular relation to respective leg 20. With canopy 12 in extended condition as illustrated here, only one pair of side bars 26 and connector 30 is visible. Each leg 20 has a lower ground engaging pin 22 which enhances ground engagement and tent stability when tent 10 is erected. After tent 10 has been erected, center post 18 is pivoted upwardly as shown by arrow T so that its lower end engages side bar 26 and the central area of the ground on which tent 10 rests is unobstructed. Repositioned center post 18' is shown in dotted lines.

Center post 18 comprises a telescoping mechanism including sliding member **18*a* which fits slidingly within channel member 18*b*. A crank and wheel device 18*c* is mounted on channel member 18*b* and is fitted with a cable 18*d*, the distal end of which is connected to an anchor point 18*e* near the lower end of sliding member 18*a*. Thus assembled, when crank and wheel device 18*c* is rotated in a direction so as to apply tension to cable 18*d***, sliding member 18*a* is elevated with respect to channel member 18*b*, thus raising the vertex or central connecting point of four roof beams 40. Crank and wheel device 18*c* includes a ratchet and pawl set, as is known, to prevent accidental loss of tension on cable 18*d*.

Figure 2:
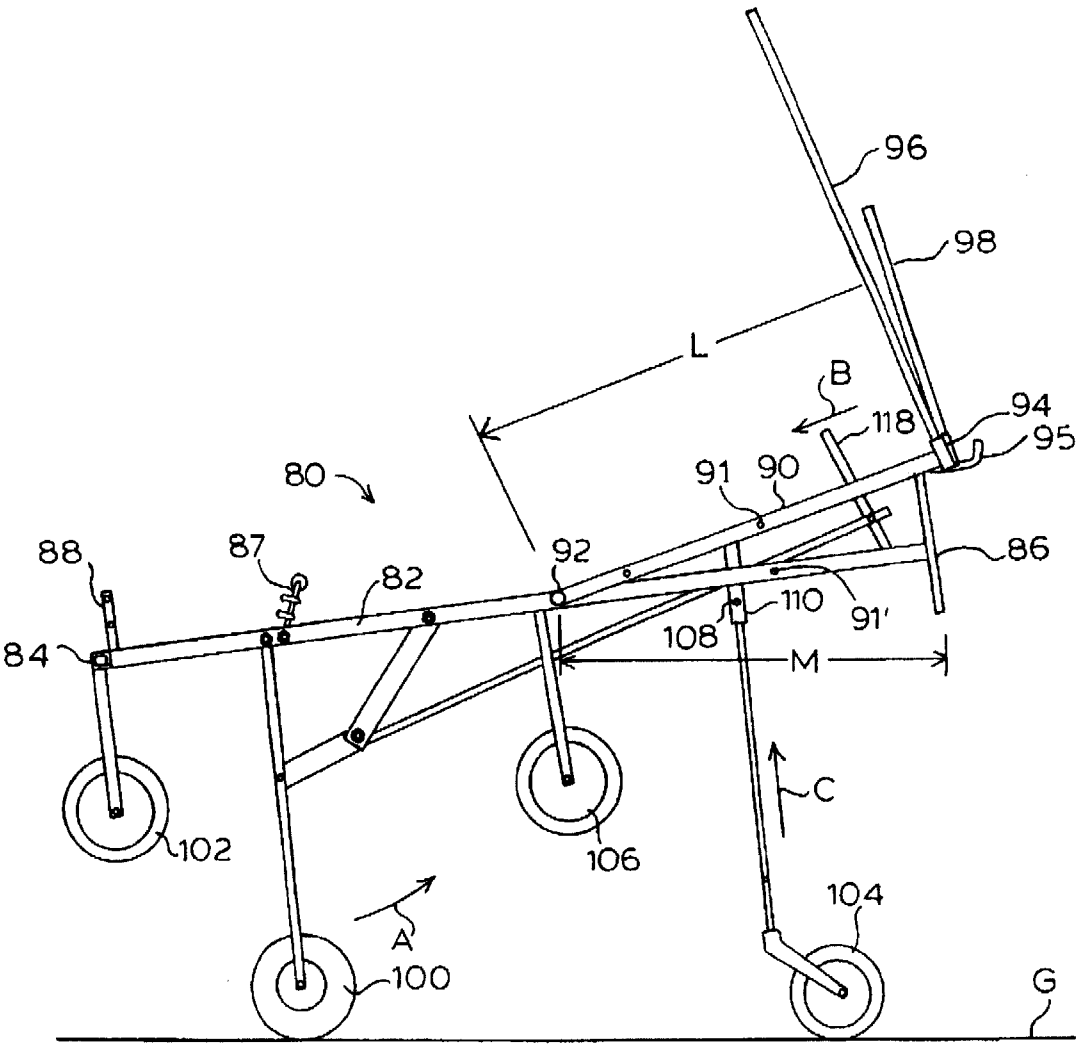
FIG. 2 is a side elevation view of a cart for use in transporting, erecting and collapsing the tent of FIG. 1 and shown in horizontal orientation.
Figure 2A:
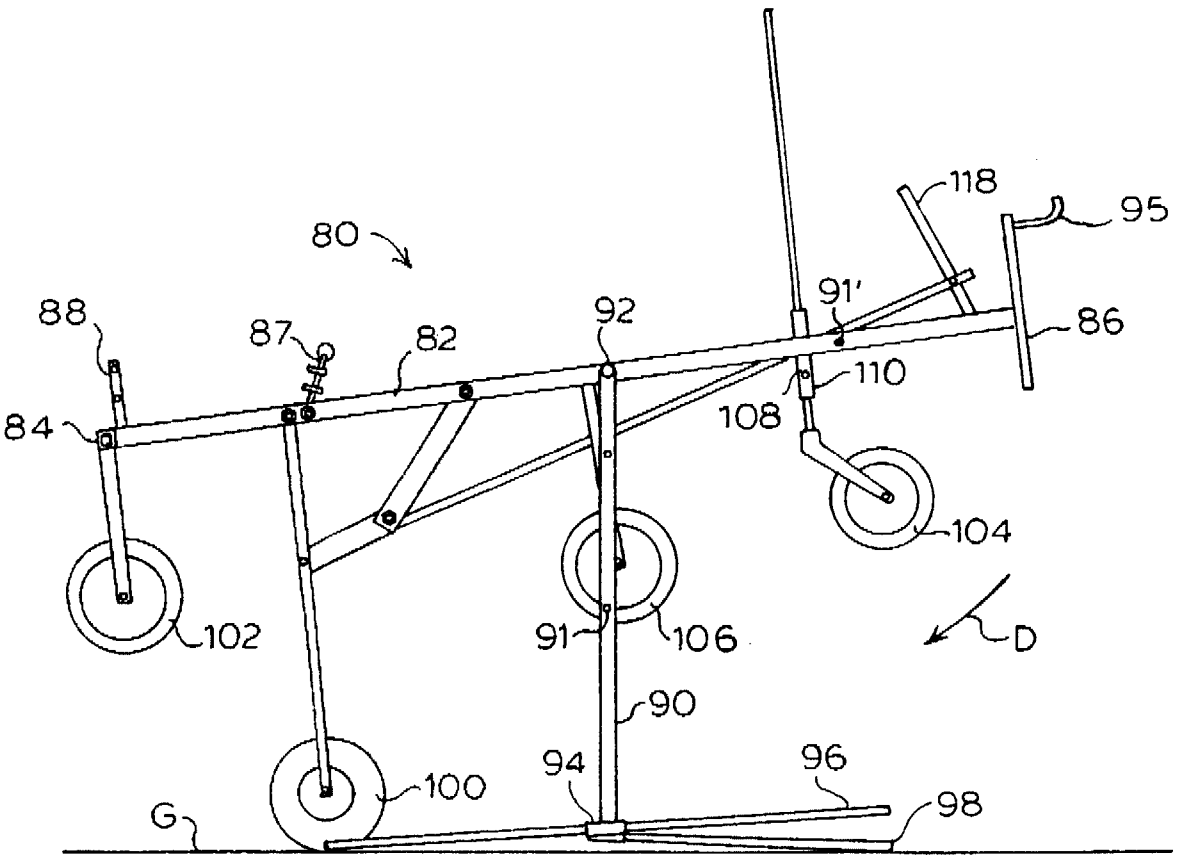
FIG. 2A is a side elevation view of the cart of FIG. 2 in horizontal orientation with a pivotable leg thereof lowered prior to rotating the cart body to be vertical.
Figure 3:
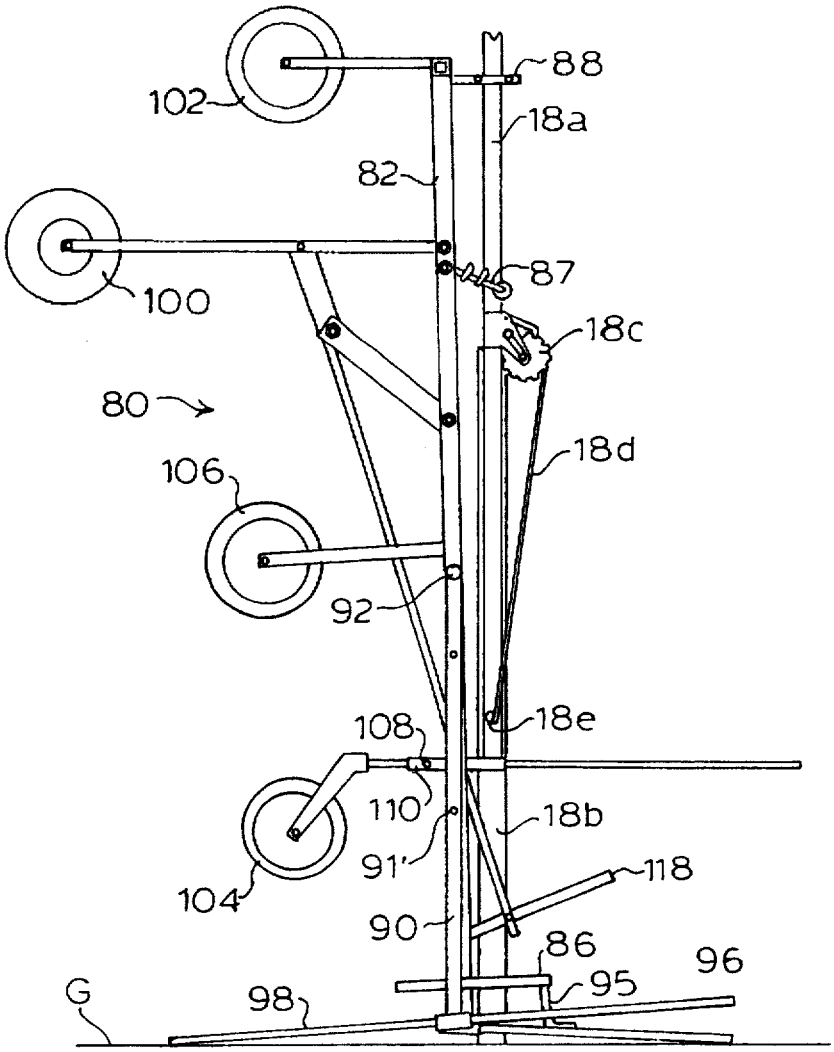
FIG. 3 is a side elevation view showing the cart of FIG. 2 in a vertical orientation and with a tent support center post connected thereto.

As noted above, tent 10 of the invention is particularly adapted to being erected and collapsed efficiently and frequently. In the process of erecting and collapsing, as well as transporting tent 10 between locations of use, cart 80, illustrated in detail in FIGS. 2, 2A and 3, is employed. While cart 80 is illustrated in FIGS. 2 and 2A with its frame 82 at an angle to the horizontal, the choice of whether to keep frame 82 level or at an angle is discretionary. Cross bar 84 is fixedly connected to frame 82 on both sides of cart 80. Cart 80 includes a pair of front wheels 100 which are mounted pivotally to frame 82 so as to collapse in the direction indicated by arrow A when handle 118 is moved in the direction indicated by arrow B. Whereas only one of each of the structural components of cart 80 is visible in the side elevation drawing, it is understood that the opposite side of cart 80 contains a similar grouping of structural components, similarly positioned. For example, the two sides of cart 80 are connected by front bar 84 at one end and rear bar 86 at the other end. Front wheels 100 are able to be raised when front dolly wheels 102 engage a supporting platform, such as, for example, the bed of a truck. When cart 80 is to be placed on such a platform, front dolly wheels 102, mounted below frame 82, are placed on or above the platform first, front wheels 100 are pivoted in the direction shown by arrow A, and cart 80 is moved forward to a point when rear dolly wheels 106 can rest on the platform. Next, rear telescoping wheels 104 are raised vertically by passing their mounting shafts through sleeves 110 in the direction indicated by arrow C to allow the rear portion of cart 80 to enter the truck bed.

Cart 80 also has pivoting leg 90 which is connected to frame 82 at pivot point 92 which is at its approximate middle. In its stored position shown in FIG. 2, leg 90 is supported on hooks 95 which are attached to rear bar 86. Cart foot 98 is fixedly attached to the end of each leg 90 adjacent sleeve 94 into which rod 96 is slidingly inserted.

Prior to rotating cart 80 to its vertical orientation, legs 90 are released from hooks 95 and moved downwardly to the position shown in FIG. 2A. Rod 96 is then moved slidingly through sleeve 94 so that approximately equal lengths extend on either side thereof. Next, telescoping wheels 104 are raised and held in place by a pin placed in hole 108 through sleeve 110 which is fixedly secured to frame 82. With rods 96 and legs 90 supporting the central portion of cart 80, the main body portion of cart 80 is rotated in the direction shown by arrow D with respect to leg 90 so as to reside substantially vertically oriented, as shown in FIG. 3. The vertical position is secured by a locking pin (not shown) inserted through hole 91 in leg 90 and frame 82. Cart 80 is positioned vertically so that center post 18 of tent 10 may be connected to bracket 88 with the lower end of center post 18 resting on the ground G for stability during collapsing of tent 10.

Figure 4A:
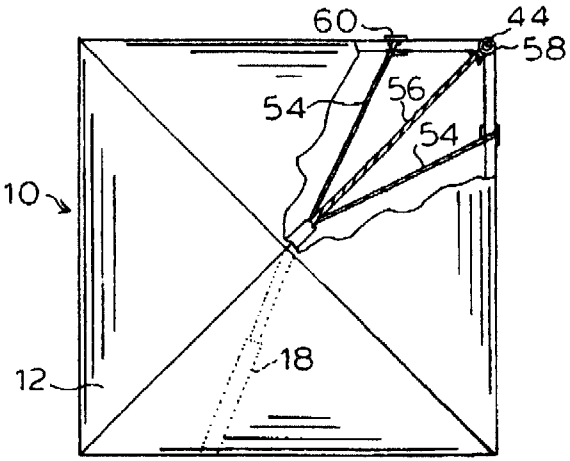
FIG. 4A is a top, partly cut away view of the tent of FIG. 1 illustrating a cord connection system for retracting the tent cloth cover.
Figure 4B:
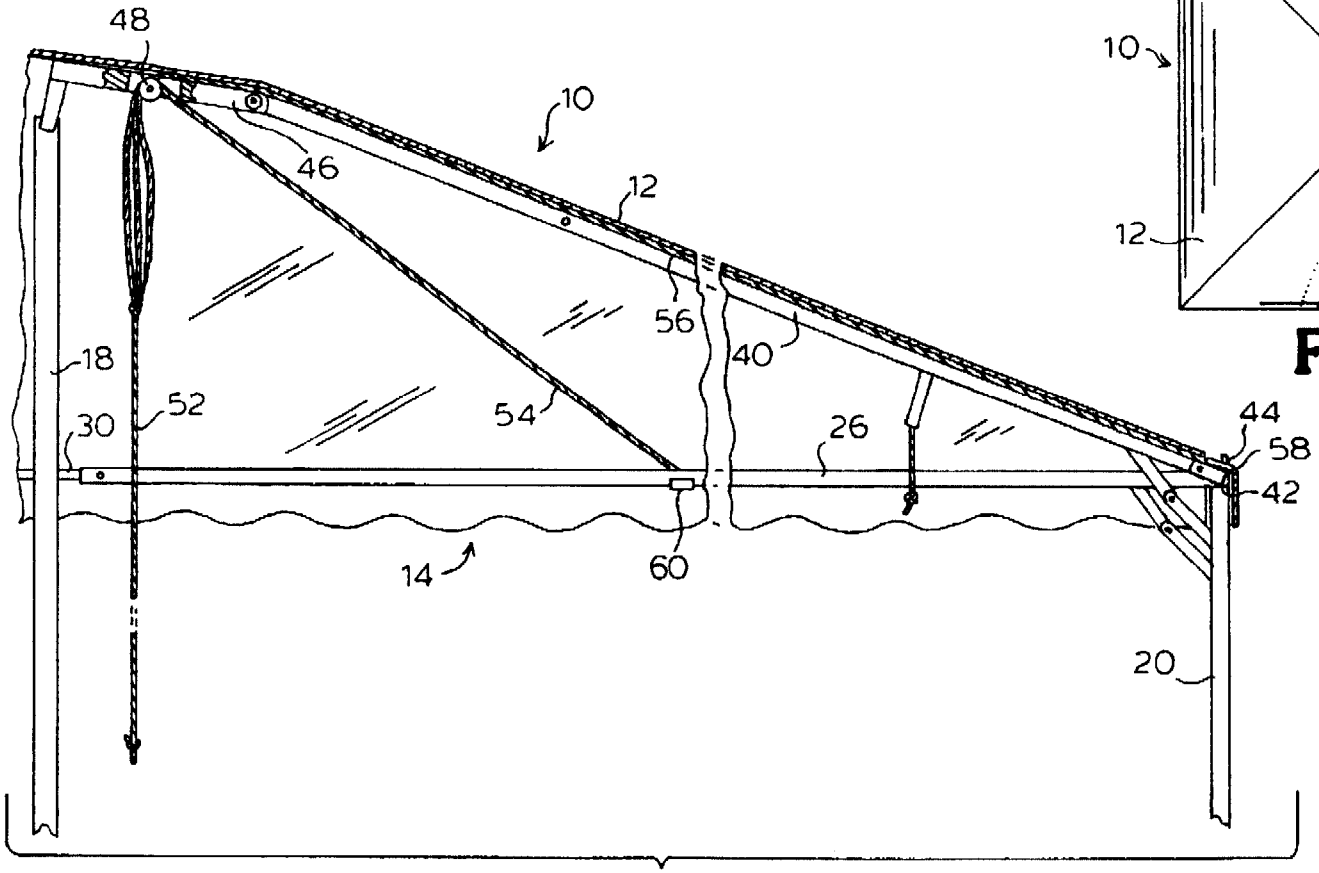
FIG. 4B is a partial side sectional view of the tent of FIG. 1 showing the cord system.

Having described cart 80 in detail above, further illustrations and description thereof will not include particular details. FIG. 4A shows a sectional top view through a cut away portion of canopy 12 of tent 10 in its erect position. FIG. 4B shows a one quarter sectional elevation of tent 10. Center post 18 and leg 20 are shown substantially mutually parallel and each being perpendicular to side bar 26. Cord 52 is shown hanging freely adjacent to center post 18. Cord 52 connects to side cords 54 and corner cord 56 (see FIG. 4A) which all pass over pulley 48. The cords 54 and 56 pass closely along the underside of canopy 12. Side cords 54 each terminate in a clip 60, which is connected to an outer edge of canopy 12 by any conventional means and is adapted to attach to side bar 26 at a location along its length. Corner cord 56 terminates in a loop 58 which is attached to canopy 12 at its corner and is adapted to engage pin 44 on the upper end of leg 20 which extends through a mating hole in tent canopy 12. In the process of collapsing tent 10, before releasing either clip 60 or loop 58, the tension on cable 18*d* is reduced and sliding member 18*a* is lowered. Clips 60 and corner loop 58 are released so as to free canopy 12 from framework 12. The worker performing the collapsing operation on tent 10, after releasing clips 60 and corner loop 58, pulls cord 52 which in turn pulls side cords 54 and corner cord 56 over pulley 48 to collapse canopy 12 upwardly along each respective roof beam 40 toward the center of the framework 14 top portion. Cord 52 is then secured to post 87 on cart 80 (see FIG. 3) to hold canopy 12 up. The canopy retraction steps described are repeated for each corner of tent 10.

Figure 5:
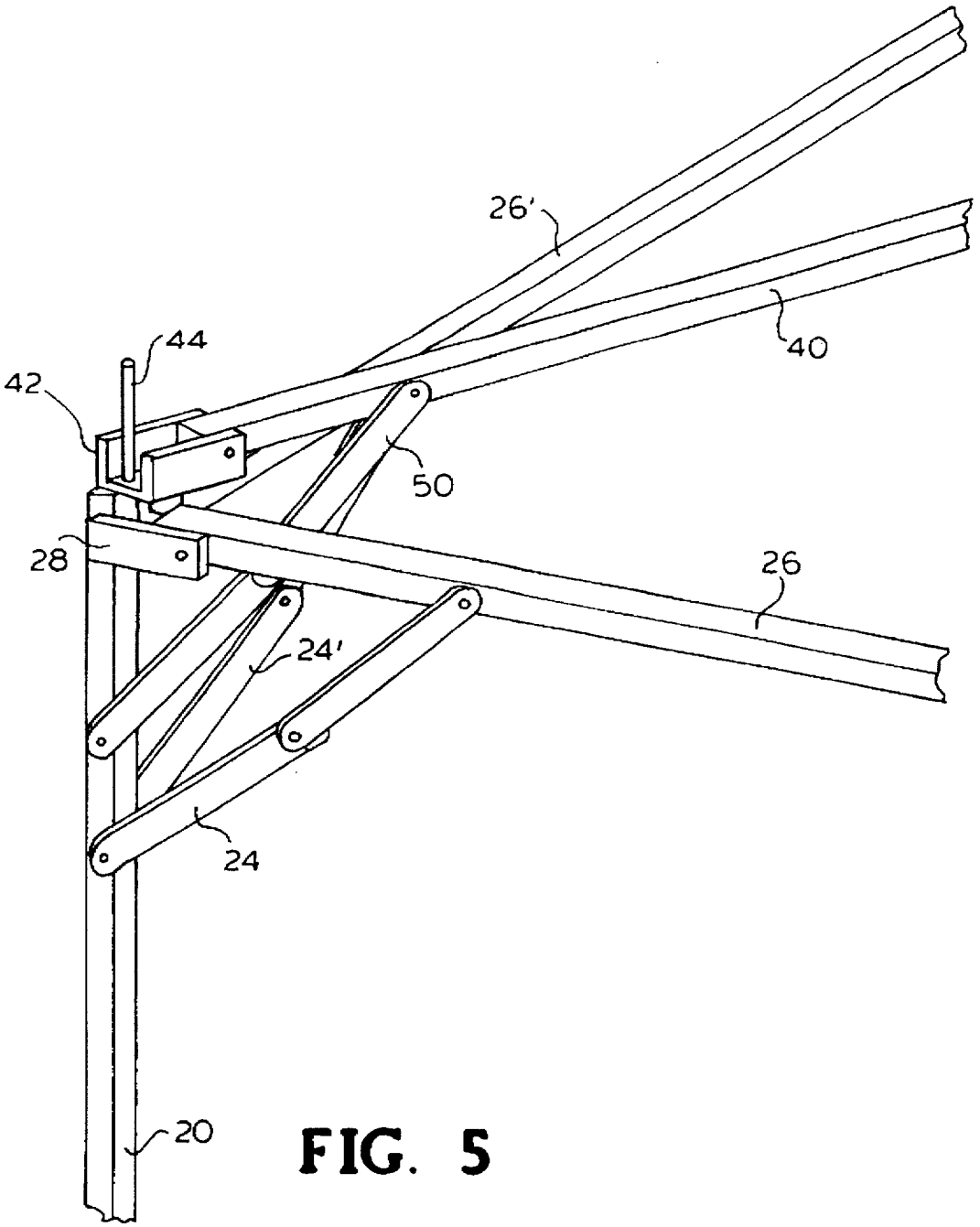
FIG. 5 is an enlarged partial side perspective view of the framework of the invention as relating to one corner of the tent, the other corners being similarly configured.

Canopy 12 is not included in the following FIGS. 5–10 for reason of clarity. A typical corner of framework 14 is illustrated in FIG. 5, which is somewhat enlarged for clarity. The illustrated corner of the tent framework includes leg 20, side bars 26 and 26' and roof beam 40, all held rigidly in their extended positions with an equal number of folding buttresses 24, 24' and 50. For example, folding buttress 24 connects side bar 26 and leg 20 to maintain a fixed angular orientation therebetween, as shown. To collapse side bar 26, folding buttress 24 is folded and side bar 26 is allowed to drop to be next to leg 20. Bracket 28 is configured to permit side bar 26 to pivot without restriction and to be parallel and close to leg 20 when folding buttress 24 is folded. Bracket 28 is rigidly mounted to leg 20 in perpendicular relation thereto. Opposite side bar 26' functions similarly in conjunction with folding buttress 24', pivotally assembled to a second side of leg 20. Roof beam 40 is supported by folding buttress 50 so as to maintain an angle above the horizontal plane which includes side bars 26 and 26'.

Figure 6:
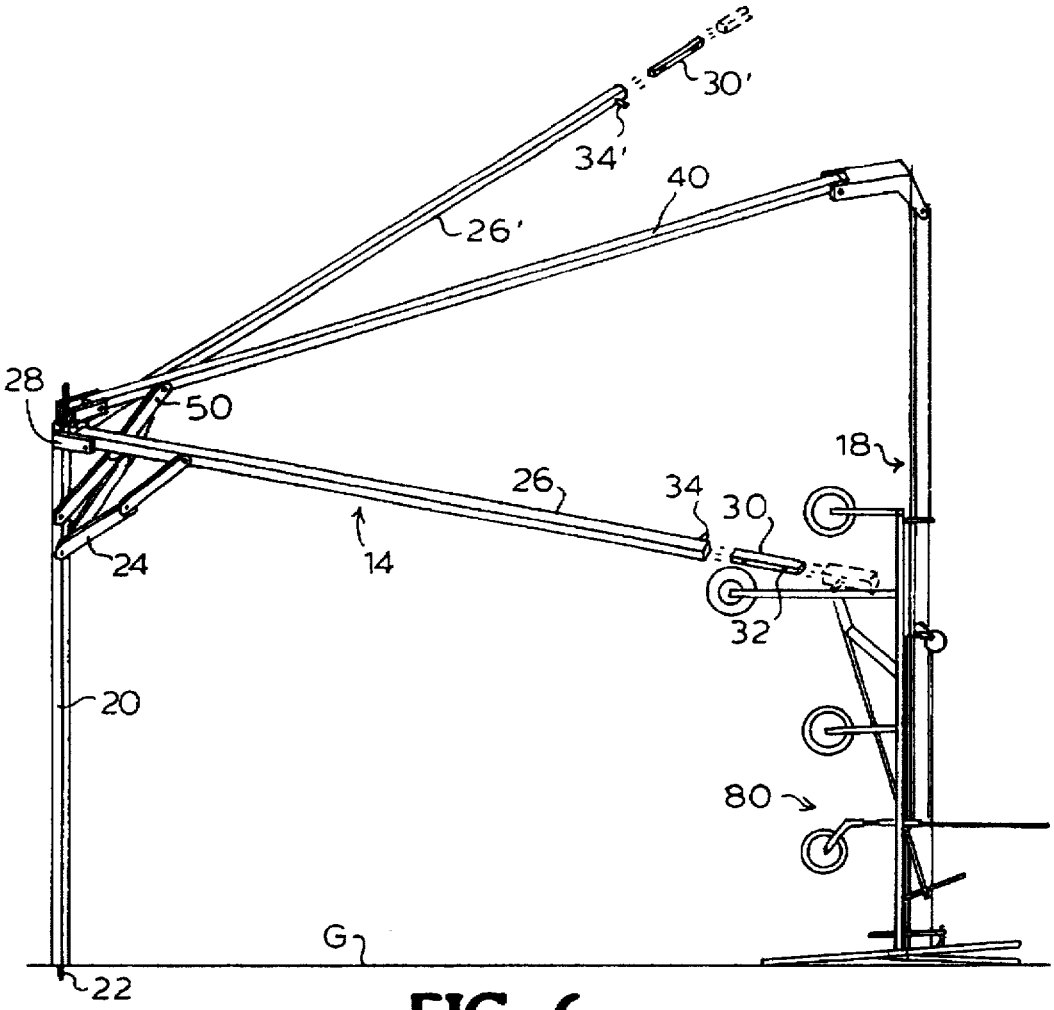
FIG. 6 is a perspective view of one corner of the framework of the invention including the center post which is being held erect by the cart of FIG. 3.
Figure 7:
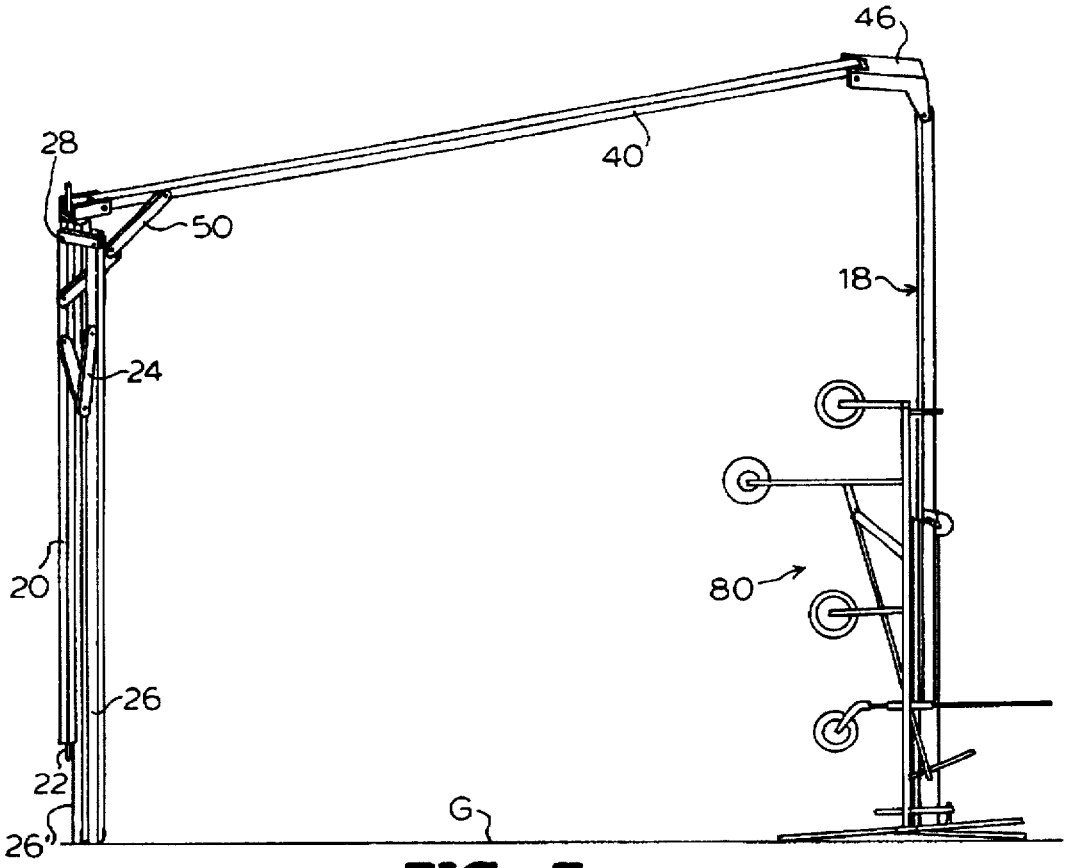
FIG. 7 is a side perspective view of one corner of the framework of FIG. 6 in which the side bars are shown in the folded position against the corner leg.
Figure 9:
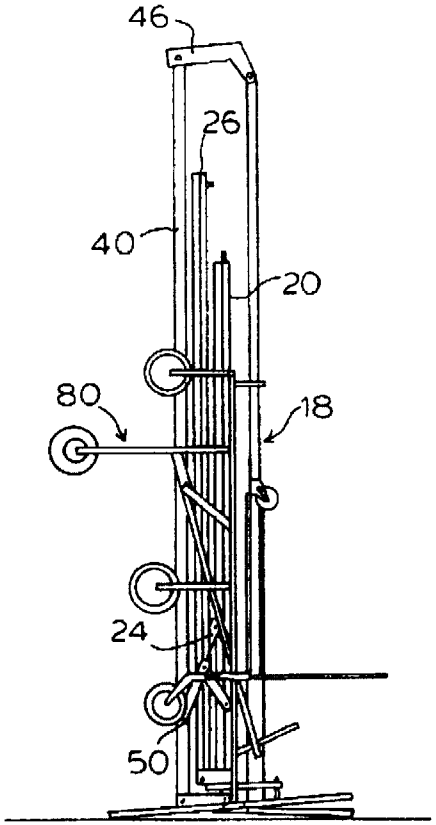
FIG. 9 is a side view of the framework of FIG. 8 in which the corner leg and side arms are folded against the roof beam and the roof beam is folded against the center post.
Figure 8:
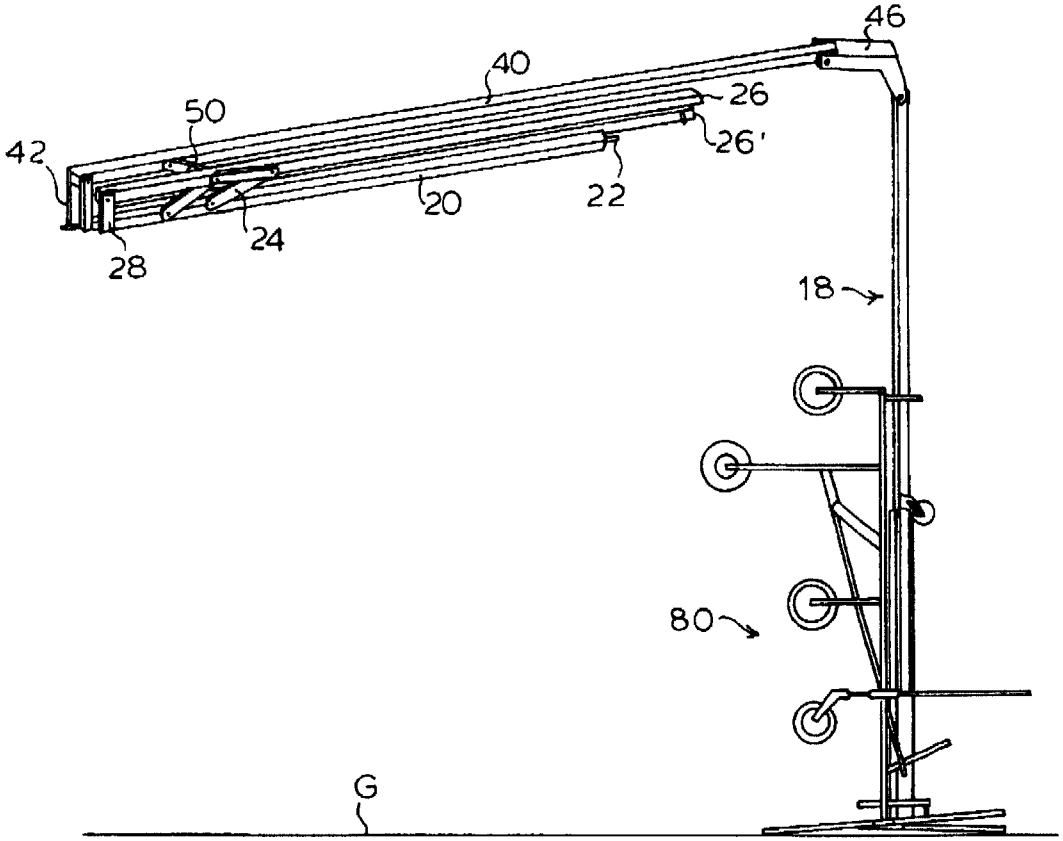
FIG. 8 is a side view of the framework of FIG. 7 in which the corner leg and side arms are shown in the folded position against the roof beam.
Figure 10:
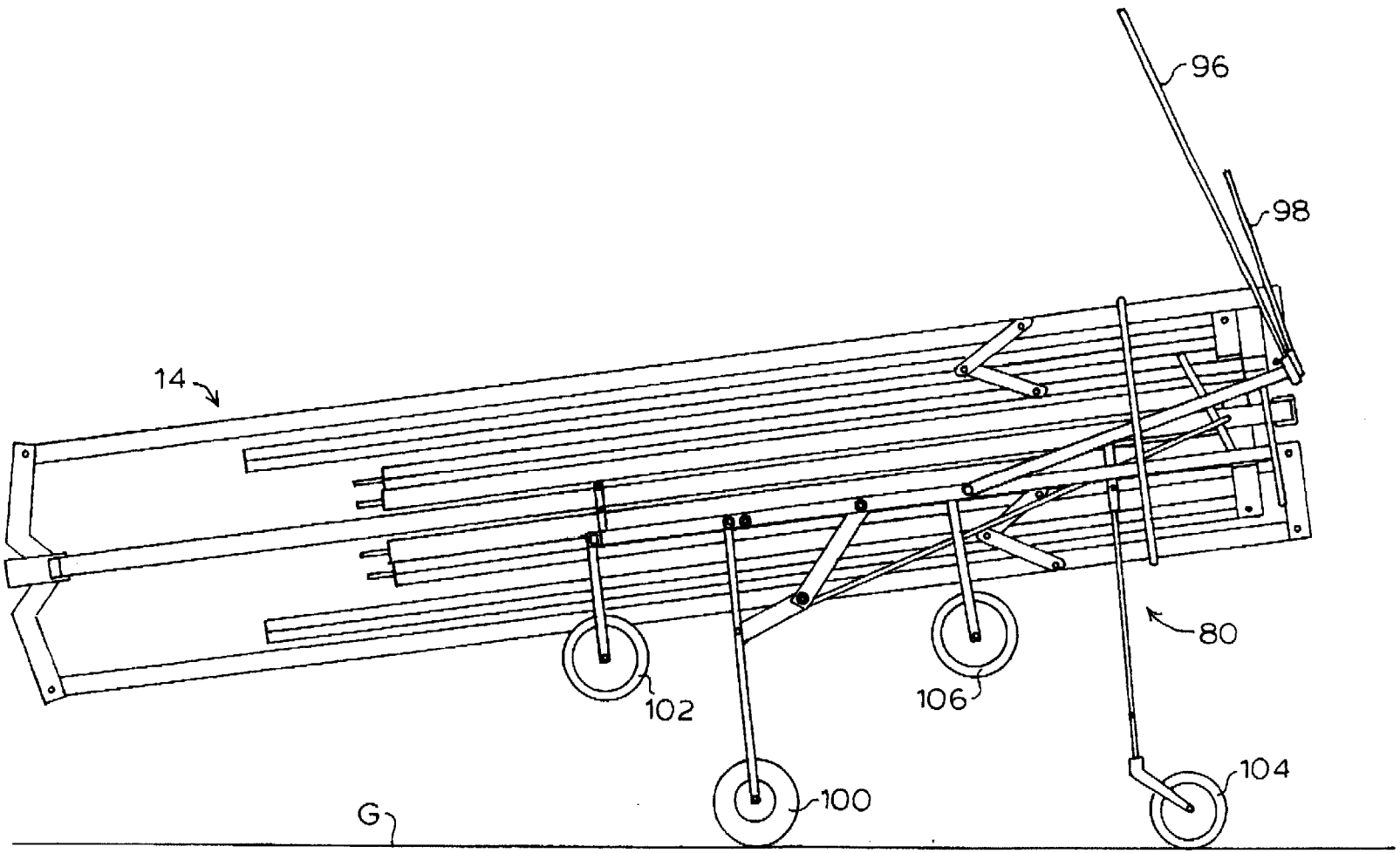
FIG. 10 is a side view of the cart of FIG. 3 with the tent framework collapsed on the cart for transport to a different location.

In FIG. 6, cart 80 is shown in its vertical orientation so as to be supportingly connected to center post 18. FIGS. 6–10 illustrate the sequential operations for collapsing tent framework 14. To begin the collapse of framework 14, spring loaded pin 34 is released to allow connection 30 to be separated from side bar 26. Next, buttress 24 is released to allow side bar 26 to drop into a position adjacent leg 20. The same steps are then performed on opposed side bar 26', to obtain the result of both side bars 26 and 26' folded close to leg 20 as shown in FIG. 7. Next, leg 20, with folded side bars 26 and 26' adjacent, is pivoted upward to rest along side of roof beam 40, as shown in FIG. 8. Almost simultaneously, roof beam 40 is lowered pivotally on pivot arm 46 to rest adjacent center post 18, as shown in FIG. 9.

The operation described with respect to the structural components comprising a single corner of framework 14 is now repeated on the three remaining corners, resulting in the collapse of all the structural components adjacent central post 18. Throughout this collapsing operation, cart 80 has been attached to and supporting post 18 in the vertical position as illustrated. Center post 18 is further collapsed to its minimum height. At this time, the collapsed structure of tent 10 is secured to cart 80 with cords or other known fastening means (not shown). The locking pin in holes 91 and 91' is released and cart 80 is rotated from vertical to horizontal, substantially reversing the operation described above, and wheels 104 lowered as shown in FIG. 10. The orientation of the four folded corner mechanisms of tent 10 with respect to cart 80 is such that securement to cart 80 involves three sets of the folded corner members located on the upper side of cart 80 and one below, when cart 80 is substantially horizontal. Cart 80 with tent 10 secured thereto is now moved to a new location.

The process of erecting tent 10 at another location involves reversing the steps described above. The erecting process begins by moving cart 80 with tent 10 fastened thereto to a desired location, lowering leg 90 and pivoting cart 80 to a vertical orientation. The following steps involve extending each respective roof beam 40, lowering each leg 20 and extending each side bar 26. Finally, adjacent side bars 26 are connected to each other with connectors 30, center post 18 is pivoted off the ground and tucked into a side bar 26 to free the ground area below.

As fully disclosed above, the tent framework of the present invention, including the special cart, provides stability throughout the operation of erecting or collapsing so that a single worker can accomplish this task. In practice, it has been discovered that the erection or collapsing operation is done by a single worker in considerably less time than was required for a team of two workers to erect or collapse previously known tents of similar size.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A tent framework for supporting a tent canopy and for improved erecting and collapsing a tent, comprising:

(a) a center post having a top end and a bottom end and adapted to be adjusted in length;

(b) a plurality of roof beams each of which being pivotally connected at a first end thereof to said top end of said center post;

(c) a plurality of legs, each being pivotally connected at a first end thereof to a second end of each of said roof beams so as to be pivotable between a first orientation at a first selected angle and a second orientation in which said leg is parallel and adjacent to said roof beam and wherein each said leg includes apparatus adapted to rigidly maintain said leg at said first selected angle to said respective roof beam;

(d) a pair of side bars connected to each of said legs adjacent said first end thereof so as to be pivotable between a first orientation at a second selected angle and a second orientation in which said side bar is parallel and adjacent to each respective said leg and each side bar including apparatus adapted to maintain each said side bar at said second selected angle with respect to each respective said leg; and (e) means for rectilinearly connecting each said side bar to a mating side bar extending from an adjacent leg when each said side bar and mating side bar are oriented at said second selected angle to each said respective leg.

2. The tent framework of claim 1, wherein said center post is pivotable at said top end to permit said bottom end to removably engage a side bar to position said center post out of contact with a surface when said framework is erected thereupon.

3. The tent framework of claim 1, wherein each said leg includes a ground engaging pin at a second end thereof.

4. The tent framework of claim 1, wherein said center post comprises a telescoping mechanism having a crank and wheel fitted with a cable and mounted on an outer channel of said post and connected to a sliding member of said post for extending the length of said center post connected thereto.

5. The tent framework of claim 1, further comprising a cart for releasably attaching and supporting said tent framework during the erecting and collapsing thereof and for transporting said tent framework when said tent framework is collapsed.

6. The tent framework of claim 5, wherein said cart includes apparatus for supporting said cart on a ground surface while a body portion of said cart is rotated between a substantially horizontal and a substantially vertical orientation.

* * * * *